US005228428A

United States Patent [19]

Jang

[11] Patent Number: 5,228,428

[45] Date of Patent: Jul. 20, 1993

[54] GREASE TRAY FOR RANGE HOODS

[76] Inventor: Sun-Sing Jang, 650, Yuan-Huan E. Rd., Fong-Yuan, Taichung Hsien, Taiwan

[21] Appl. No.: 981,841

[22] Filed: Nov. 25, 1992

[51] Int. Cl.[5] ..... F24C 15/20

[52] U.S. Cl. ..... 126/299 D; 126/299 R

[58] Field of Search ..... 126/299 R, 299 D

[56] References Cited

U.S. PATENT DOCUMENTS 4,500,331 2/1991 Cheng ..... 126/299 D
4,506,655 3/1985 Kuechler ..... 126/299 D
5,027,790 7/1991 Sheng ..... 126/299 R

*Primary Examiner*—Carroll B. Dority
*Attorney, Agent, or Firm*—Browdy and Neimark

[57] ABSTRACT

A grease tray for range hoods comprises a main member and an auxiliary member. The main member has a disk ring provided mainly with a first upright ring portion and a shoulder portion having thereon a second upright ring portion with a tenon located on the inner circumference thereof. The disk ring is further provided with a grease outlet. The auxiliary member has a planar ring provided with an inner wall, an outer wall, and a high wall portion located between the inner wall and the outer wall so as to form an outer slot and a middle slot. The outer slot has a grease draining hole while the middle slot has at least one through hole. The outer wall of the auxiliary member is provided with a mortise corresponding in location to the tenon of the main member. The main member and the auxiliary member are put together by means of the tenon and the mortise, in a manner that the bottom of the outer wall is located on the shoulder portion.

12 Claims, 8 Drawing Sheets

GREASE TRAY FOR RANGE HOODS

BACKGROUND OF THE INVENTION

The present invention relates to a grease tray, and more particularly to a grease tray for use in a range hood.

As shown in FIGS. 1 and 2, a portion of the cooking fume is blown out in a direction tangential to the blade face of an air impeller 11 at such time when a fume exhauster 10 is running. For this reason, a grease tray 14 of a plastic material is mounted between an air inlet 121 of an air guiding box 12 and an air suction port 131 of a bottom plate 13. Now referring to FIGS. 3 and 4, the grease tray 14 of the prior art is shown to comprise a centrally located air hole 141 having an outer circumference provided with an annular groove 142. A grease tube 143 is disposed at an appropriate location in the outer wall forming the annular groove 142.

The way in which the cooking fume exhauster 10 is set up, as described above, is in fact a time-honored practice in the industry. However, such mechanical set-up of the prior art has a major shortcoming, which is explicitly expounded hereinafter.

As soon as a motor 15 of the fume exhauster 10 is started, the cooking fume is guided into the air guiding box 12 by a suction effect of the air impeller 11 at work. The fume is then guided by a centrifugal effect to move along a direction tangential to the blade face of the air impeller 11 to reach an inner wall 122 of the air guiding box 12, wherefrom the fume moves on in a direction indicated by a small arrow 17 to arrive at a bottom wall 123 of the air guiding box 12. The grease vapor carried in the fume is then collected in the annular groove 142 of the grease tray 14. The grease so collected is finally kept in a grease container via the grease tube 143. However, in the course of exhausting the cooking fume, as described above, it is often found that the grease vapor flows from the bottom wall 123 of the air guiding box 12 in several directions, as indicated by arrows 18, in a manner that the grease vapor flows through the annular groove 142 of the grease tray 14 to reach the air suction port 131 of the bottom plate 13. As a result, the grease often drips from the air suction port 131 into the kitchen utensils sitting on the range. Needless to say, a housewife is annoyed by such incident of the grease dripping.

SUMMARY OF THE INVENTION

The primary objective of the present invention to provide a grease tray with means capable of preventing the collected grease from dripping out of the bottom wall of the air guiding box of the range hoods.

According to the present invention, a grease tray comprises a main member and an auxiliary member. The main member has a disk ring provided mainly with a first upright ring portion and a shoulder portion having thereon a second upright ring portion with a tenon located on the inner circumference thereof. The disk ring is further provided with a grease outlet. The auxiliary member has a planar ring provided with an inner wall, an outer wall, and a high wall portion located between the inner wall and the outer wall so as to form an outer slot and a middle slot. The outer slot has a grease draining hole while the middle slot has at least one through hole. The outer wall of the auxiliary member is provided with a mortise corresponding in location to the tenon of the main member. The main member and the auxiliary member are put together by means of the tenon and the mortise, in a manner that the bottom of the outer wall is located on the shoulder portion.

The present invention may best be understood through the following description with reference to the accompanying drawings, in which:

DETAILED DESCRIPTION OF THE PREFERRED EMBODIMENTS

Figure 1:
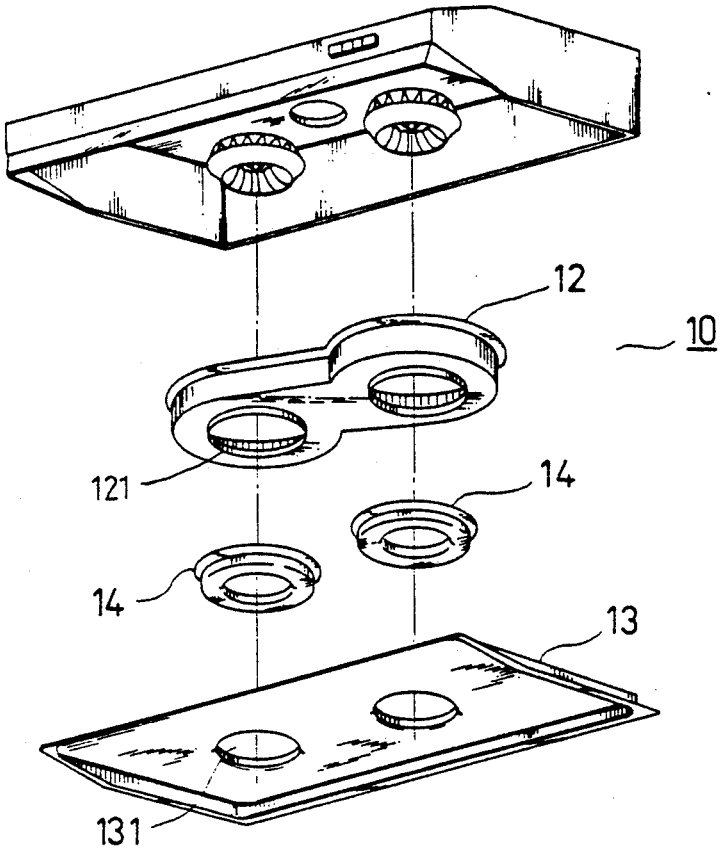
FIG.1 (PRIOR ART)
FIG. 1 is a three-dimensional analytical perspective of a conventional range hood.
Figure 2:
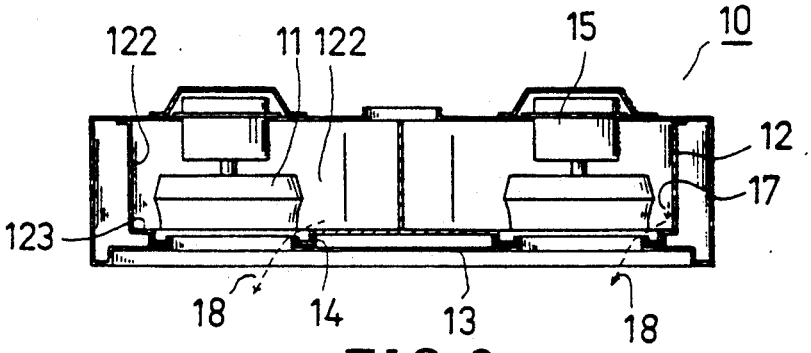
FIG.2 (PRIOR ART)
FIG. 2 is a sectional view of a range hood in combination as shown in FIG. 1.
Figure 3:
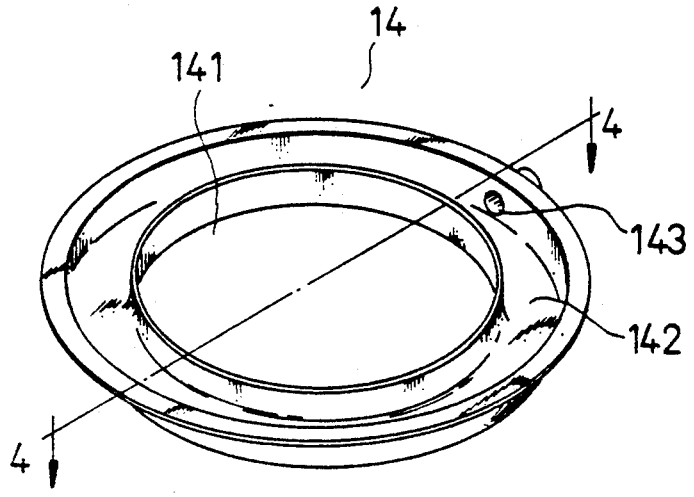
FIG. 3 (PRIOR ART)
FIG. 3 is a perspective view of the conventional grease tray in FIG. 1.
Figure 4:
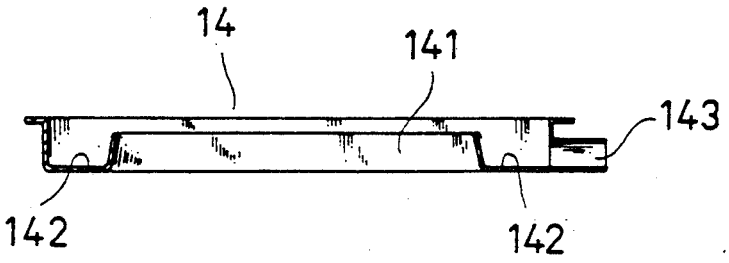
FIG. 4 (PRIOR ART)
FIG. 4 is a sectional view taken along line 4—4 in FIG. 3.
Figure 5:
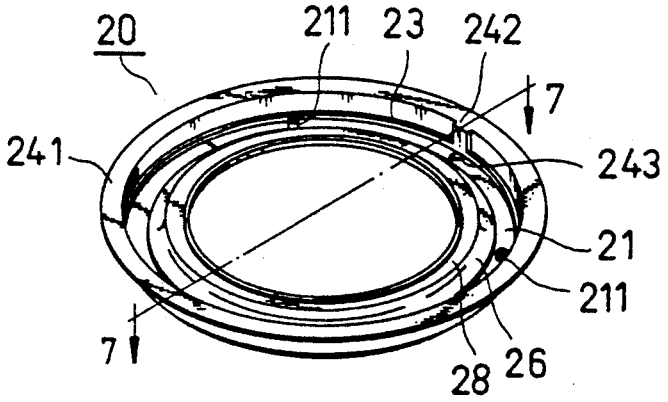
FIG. 5 is a perspective view of a main member 20 according to the present invention.
Figure 6:
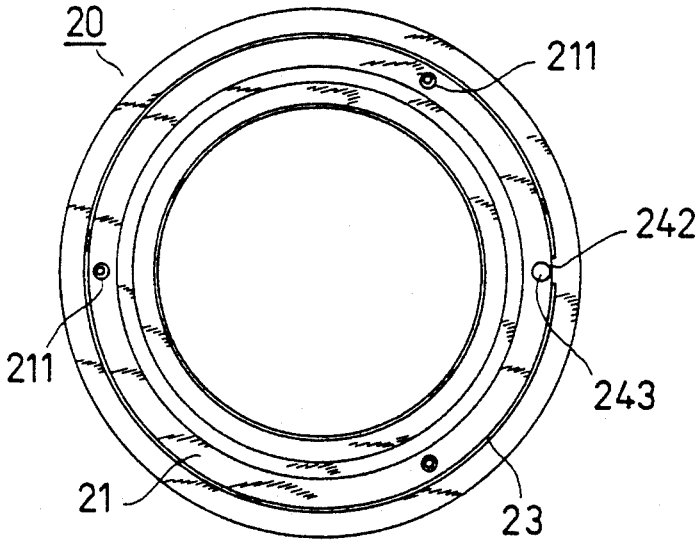
FIG. 6 is a top plan view showing a main member in FIG. 5.
Figure 7:
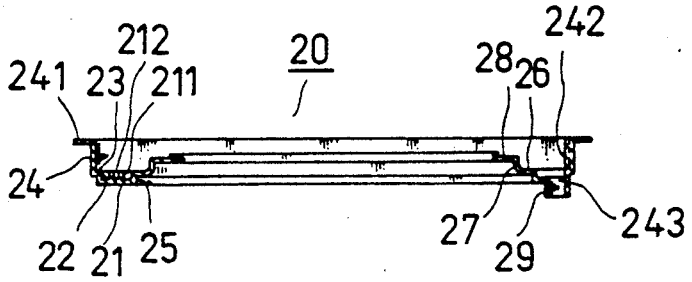
FIG. 7 is a sectional view taken along line 7—7 in FIG. 5.
Figure 8:
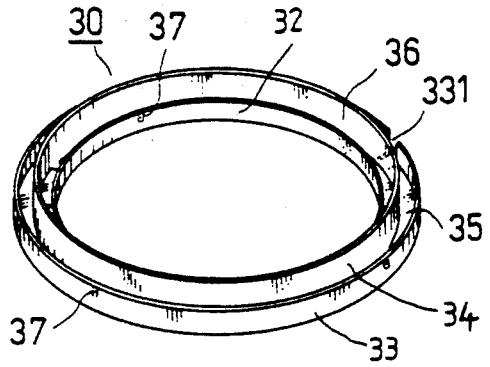
FIG. 8 is a perspective view of an auxiliary member 30 according to the present invention.
Figure 9:
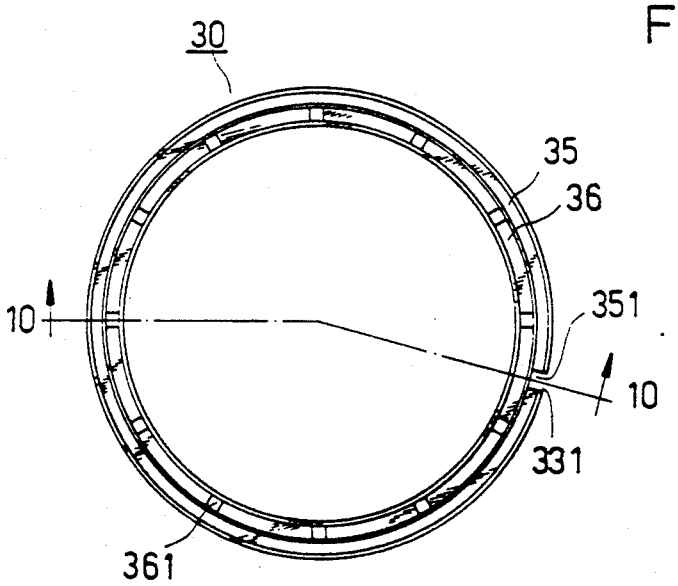
FIG. 9 is a top plan view showing an auxiliary member in FIG. 8.
Figure 10:
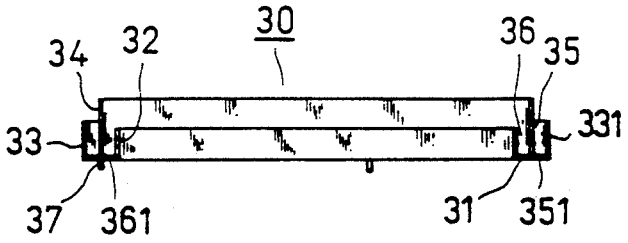
FIG. 10 is a sectional view taken along line 10—10 in FIG. 9.

Referring to FIGS. 5–11, a grease tray of the present invention is shown to be composed of a main member 20 and an auxiliary member 30.

The main member 20 has a disk ring 21, which is kept on a horizontal level. The disk ring 21 is provided on the upper surface thereof with three spaced support pillars 211, each of which has a blind hole 212 located at the top surface thereof. The disk ring 21 is further provided on the outer edge thereof with a first upright ring portion 22 extending upwards. The first upright ring portion 22 is provided on the top edge thereof with a shoulder portion 23 extending outwards. The shoulder portion 23 has a second upright ring portion 24 located on the outer edge thereof in a manner that the second upright ring portion 24 extends upwards. The second upright ring portion 24 has an arresting portion 241 extending outwards from the top edge of the second upright ring portion 24. In addition, the second upright ring portion 24 is provided with a tenon 242 located at an appropriate position on the inner circumference of the second upright ring portion 24. The disk ring 21 is provided on the inner edge thereof with a third upright ring portion 25 extending upwards and with a lower planar ring portion 26 extending inwards and having a recessed and arcuate inner ring portion 27 extending upwards from the inner edge of the lower planar ring portion 26. Located on the top edge of the inner ring portion 27 is an upper planar ring portion 27 extending inwards. The disk ring 21 is further provided with a grease outlet 243 under which there is a grease draining tube 29.

The auxiliary member 30 has a planar ring 31 provided respectively on the inner and the outer edges thereof with an inner wall 32 extending upwards and with an outer wall 33 extending upwards. Located between the inner and the outer walls 32 and 33 is a high wall portion 34 for forming an outer slot 35 and a middle slot 36. The outer slot 35 is provided in the bottom wall thereof with a grease draining hole 351 while the middle slot 36 is provided on the bottom wall thereof with a plurality of holes 361 that are spaced appropriately. The outer wall 33 is provided with a mortise 331 corresponding in location to the grease draining hole 351. The planar ring 31 further has three insertion rods 37 extending downwards from the bottom of the planar ring 31. Each of the three insertion rods 37 has an outer diameter slightly smaller than an inner diameter of the blind hole 212 of the main member 20.

In combination, the tenon 242 of the main member 20 is fitted into the mortise 331 of the auxiliary member 30, with each of the three insertion rods 37 fitted into the blind hole 212 of each of the three support pillars 211. As a result, the auxiliary member 30 is securely located. The bottom of the outer wall 33 of the auxiliary member 30 is placed on the shoulder portion 23 of the main member 20 so that the grease draining hole 351 of the auxiliary member 30 is corresponding in location to the grease outlet 243 of the main member 20.

Figure 11:
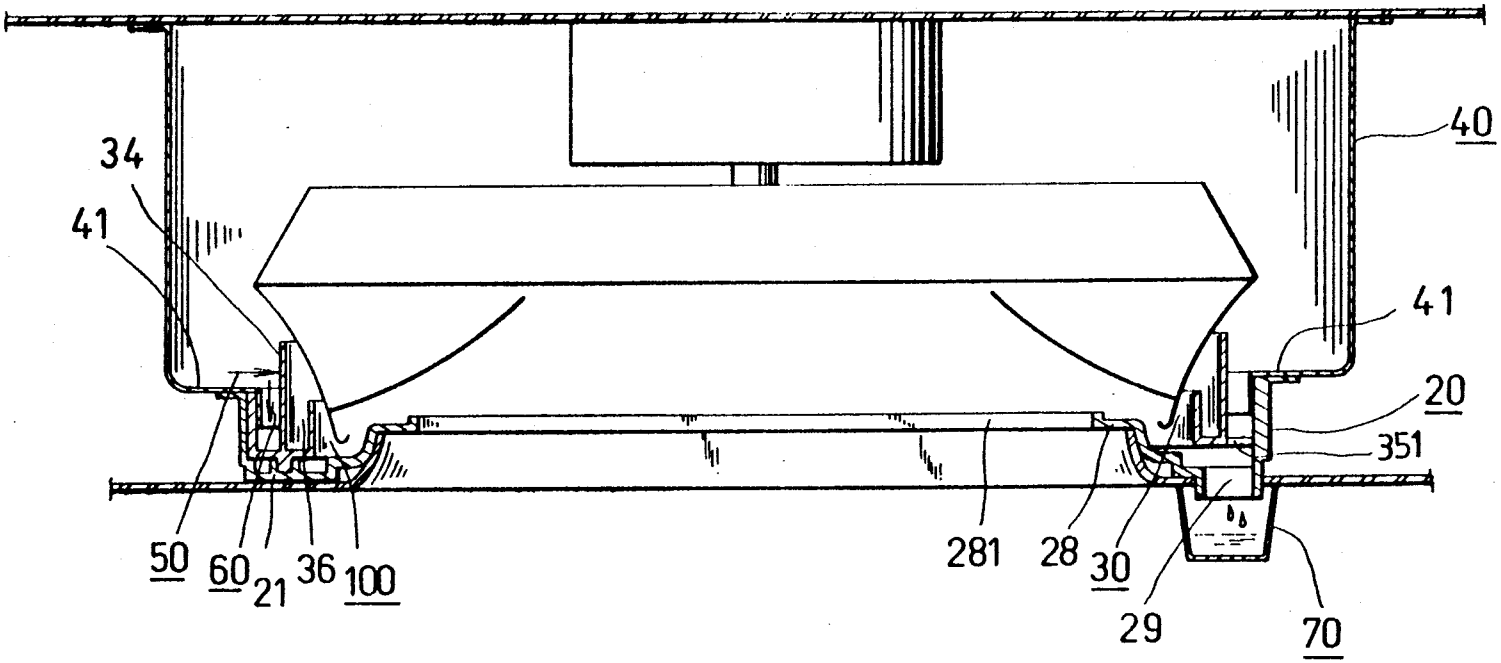
FIG. 11 is a schematic view of the present invention at work state.
Figure 12:
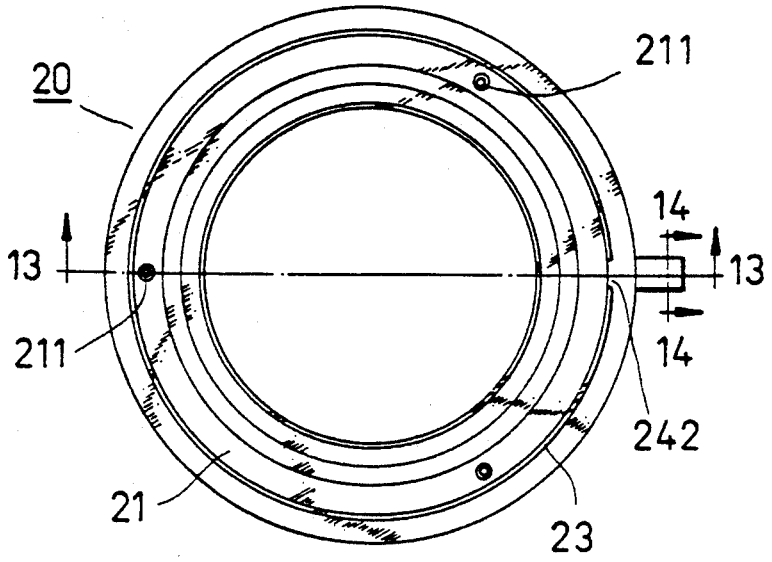
FIG. 12 is a top plan view of another preferred embodiment of a main member according to the present invention.
Figure 13:
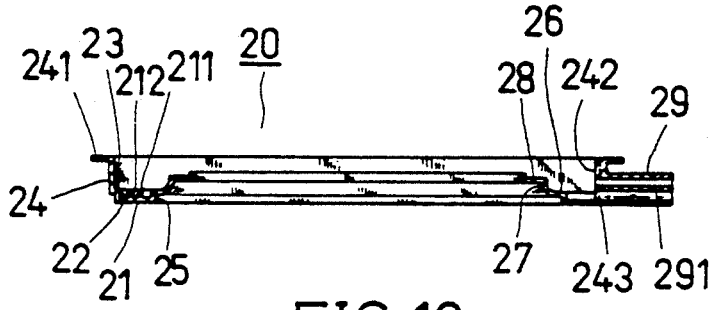
FIG. 13 is a sectional view taken along line 13—13 in FIG. 12.
Figure 14:
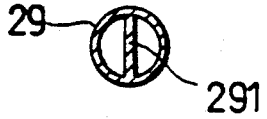
FIG. 14 is a sectional view taken along line 14—14 in FIG. 12.
Figure 15:
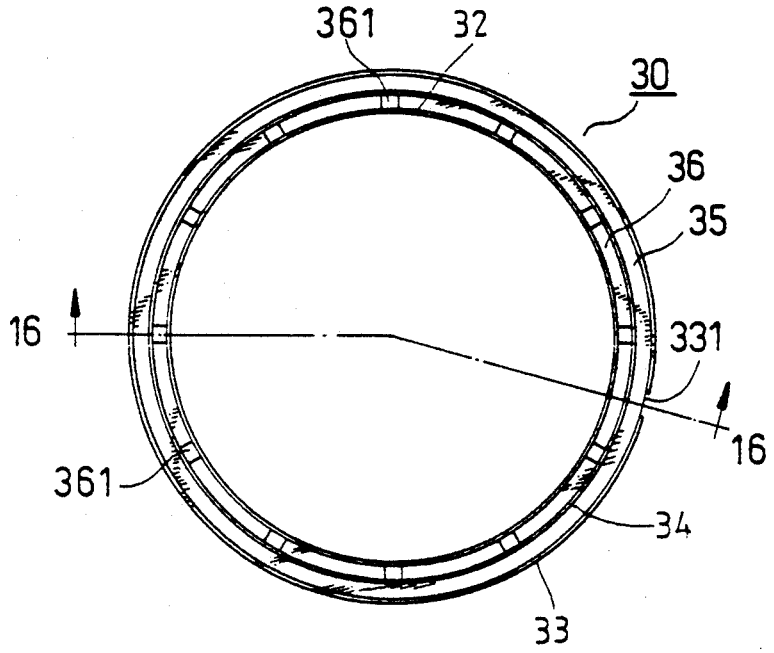
FIG. 15 is a top plan view of another preferred embodiment of an auxiliary member according to the present invention.
Figure 16:
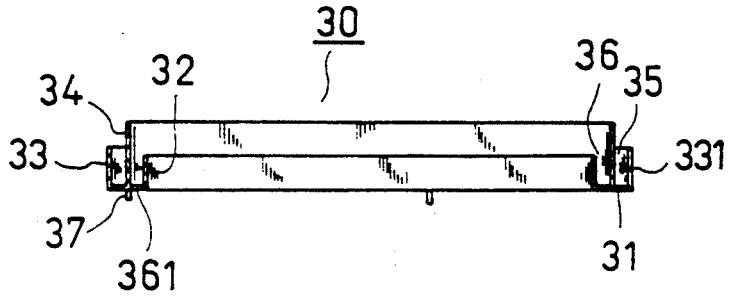
FIG. 16 is a sectional view taken along line 16—16 in FIG. 15.
Figure 17:
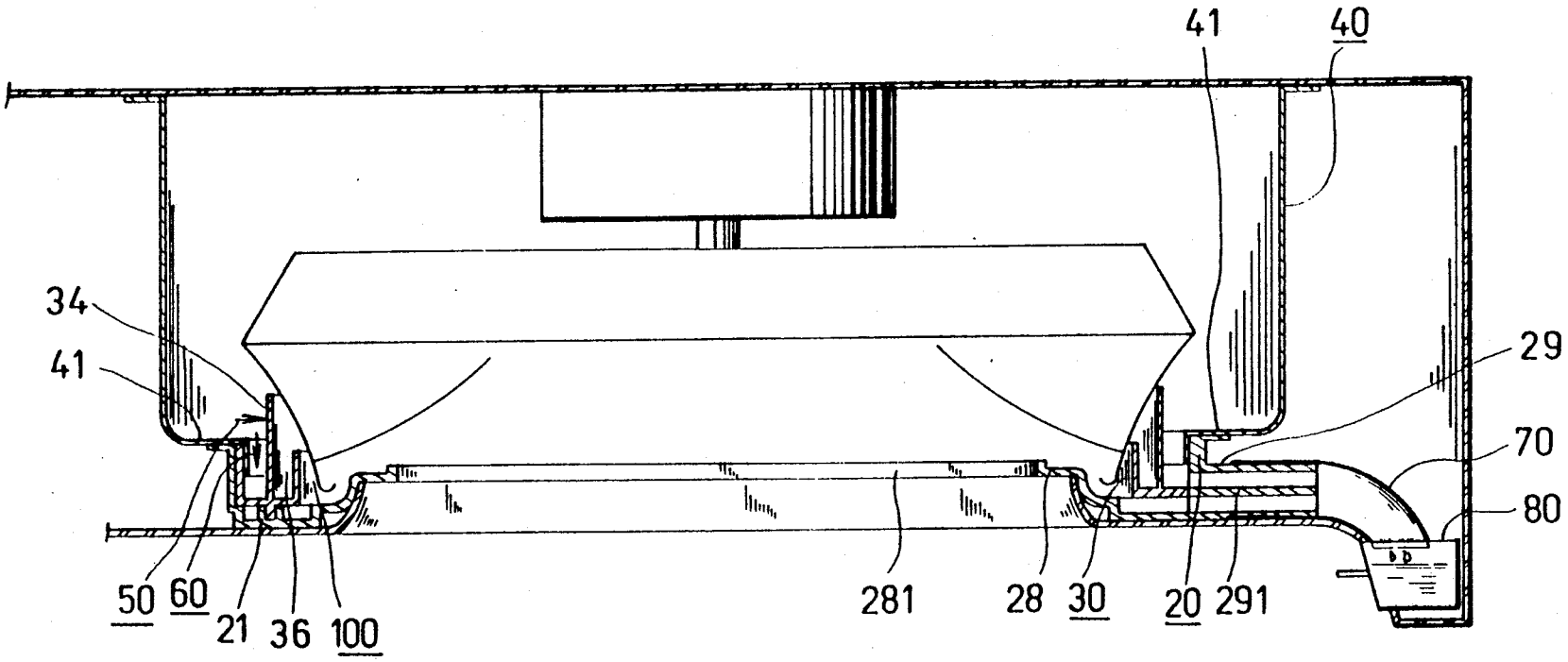
FIG. 17 is a schematic view of another preferred embodiment at work state according to the present invention.

As shown in FIG. 11, the high wall portion 34 and the inner wall 32 of the auxiliary member 30 serve as dual shields, with the high wall portion 34 obstructing the grease splashed by the air current in a direction indicated by an arrow 50. The obstructed grease is forced to flow in a direction indicated by an arrow 60 into the outer slot 35 and then into the top of the disk ring 21 of the main member 20 via the grease draining hole 351 of the auxiliary member 30. Some of the grease is collected in the middle slot 36 of the auxiliary member 30 and is then guided to flow into the top of the disk ring 21 of the main member 20 via the holes 361 of the middle slot 36. The main member 20 is further provided with an inner slot 100 for collecting a less amount of the grease. All the collected grease is then drained into a grease collecting cup 70 via the grease draining tube 29. As a result, the grease is prevented from being splashed into the kitchen utensils sitting on the range via an air inlet 281 of the main member 20.

A second preferred embodiment of the present invention is illustrated in FIGS. 12–17. In the second preferred embodiment, the grease outlet 243 of the main member 20 is arranged under the tenon 242 of the second upright portion 24. The grease outlet 243 is in communication with the grease draining tube 29 dispossed horizontally. The outer slot 35 of the auxiliary member 30 is devoid of the grease draining hole 351. As a result, the grease collected in the auxiliary member 30 is guided to flow to the grease draining tube 29 via the mortise 331. The grease is finally guided via a duct 70 to a grease collecting cup 80 located at the rear section of the housing interior of the range hood. In addition, the grease draining tube 29 comprises therein a horizontally arranged partition wall 291 located at the mid-point of the tube 29 and made integrally with the tube 29. The partition wall 291 prevents the grease, which flows out of the mortise 331, from dripping back into the top of the disk ring 21 of the main member 20.

While the invention has been described in connection with what is presently considered to be the most practical and preferred embodiments, it is to be understood that the invention is not to be limited to the disclosed embodiments but on the contrary, is intended to cover various moditications and equivalent arrangements included within the spirit and scope of the appended claims which scope is to be accorded the broadest interpretation so as to encompass all such modifications and equivalent structures.

What I claim is:

1. A grease tray for range hoods comprising:

a main member having a disk ring with an outer edge provided with a first upright ring portion extending upwards and with a shoulder portion extending outwards and having an outer edge provided with a second upright ring portion extending upwards, said second upright ring portion having a tenon located on an inner circumference thereof, said disk ring having an inner edge provided with at least an upright ring portion extending upwards and having an appropriate height, said main member further having a grease outlet located at an appropriate position thereof; and an auxiliary member having a planar ring with an inner edge and an outer edge which are provided respectively with an inner wall and an outer wall, said auxiliary member further having a high wall portion located between said inner wall and said outer wall so as to form an outer slot and a middle slot, with said outer slot provided with a grease draining hole and with said middle slot having a bottom wall provided with at least one through hole, said outer wall of said auxiliary member having a recess cut corresponding in location to said tenon of said second upright ring portion of said main member so as to allow said auxiliary member to be put together with said main member by fitting said tenon into said recess cut in a manner that the bottom of said outer wall of said auxiliary member is located on said shoulder portion of said main member.

2. The grease tray for range hoods of claim 1 wherein said disk ring has a top surface provided thereon with a plurality of support pillars spaced appropriately, each of which has a blind hole going downwards from a top surface thereof, said disk ring further having a bottom surface provided thereon with a plurality of insertion rods corresponding in location and number to said support pillars, with each of said insertion rods having an outer diameter slightly smaller than an inner diameter of said blind hole of said each of said support pillars so that said each of said insertion rods can be inserted into said blind hole of said each of said support pillars.

3. The grease tray for range hoods of claim 1 wherein said middle slot of said auxiliary member is provided in said bottom wall thereof with a plurality of through holes spaced at an interval of 30 degrees.

4. The grease tray for range hood of claim 2 wherein said middle slot of said auxiliary member is provided in said bottom wall thereof with a plurality of through holes spaced at an interval of 30 degrees.

5. The grease tray for range hoods of claim 1 wherein said grease outlet of said main member is located on said disk ring and is in communication with a grease draining tube; and wherein said grease draining hole of said auxiliary member is located in said bottom wall of said outer slot.

6. The grease tray for range hoods of claim 2 wherein said grease outlet of said main member is located on said disk ring and is in communication with a grease draining tube; and wherein said grease draining hole of said auxiliary member is located in said bottom wall of said outer slot.

7. The grease tray for range hoods of claim 5 wherein said grease outlet of said main member is corresponding in location to said tenon; and wherein said grease draining hole of said auxiliary member is corresponding in location to said grease outlet of said main member.

8. The grease tray for range hoods of claim 6 wherein said grease outlet of said main member is corresponding in location to said tenon; and wherein said grease draining hole of said auxiliary member is corresponding in location to said grease outlet of said main member.

9. The grease tray for range hoods of claim 1 wherein said grease outlet of said main member is located under said tenon of said second upright ring portion and is in communication with a horizontally arranged grease draining tube extending outwards; and wherein said recess cut of said auxiliary member has a lower segment serving as a grease draining hole.

10. The grease tray for range hoods of claim 2 wherein said grease outlet of said main member is located under said tenon of said second upright ring portion and is in communication with a horizontally arranged grease draining tube extending outwards; and wherein said recess cut of said auxiliary member has a lower segment serving as a grease draining hole.

11. The grease tray for range hoods of claim 9 wherein said grease draining tube is provided therein with a horizontally arranged partition wall located at a mid-point of said grease draining tube and made integrally with said grease draining tube.

12. The grease tray for range hoods of claim 10 wherein said grease draining tube is provided therein with a horizontally arranged partition wall located at a mid-point of said grease draining tube and made integrally with said grease draining tube.

* * * * *